US007731062B2

(12) United States Patent
Groys

(10) Patent No.: US 7,731,062 B2
(45) **Date of Patent: *Jun. 8, 2010**

(54) APPARATUS AND METHOD FOR DISPENSING LIQUIDS

(75) Inventor: Aleksandr Groys, Beachwood, OH (US)

(73) Assignee: Gebauer Company, Cleveland, OH (US)

( * ) Notice: Subject to any disclaimer, the term of this patent is extended or adjusted under 35 U.S.C. 154(b) by 1399 days.

This patent is subject to a terminal disclaimer.

(21) Appl. No.: 11/071,642

(22) Filed: Mar. 3, 2005

(65) Prior Publication Data

US 2005/0150910 A1 Jul. 14, 2005

Related U.S. Application Data

(63) Continuation-in-part of application No. 11/026,588, filed on Dec. 30, 2004, which is a continuation of application No. 10/343,723, filed as application No. PCT/US01/29627 on Sep. 21, 2001, now Pat. No. 6,837,401.

(60) Provisional application No. 60/234,488, filed on Sep. 22, 2000.

(51) Int. Cl.
*B65D 83/00* (2006.01)

(52) U.S. Cl. ..... 222/189.11; 222/402.1; 222/402.12; 222/494; 239/575; 239/590.3

(58) Field of Classification Search ..... 222/189.11, 222/189.06, 189.1, 402.1, 402.12, 402.13, 222/189.08; 239/575, 590, 590.3
See application file for complete search history.

(56) References Cited

U.S. PATENT DOCUMENTS

| | | | | |
|---|---|---|---|---|
| 2,373,037 | A * | 4/1945 | Lindsay | 220/88.3 |
| 2,418,036 | A | 3/1947 | Lane | |
| 2,774,628 | A | 12/1956 | Engstrum | |
| 2,995,308 | A | 8/1961 | Ashkenaz | |
| 3,756,472 | A * | 9/1973 | Vos | 222/189.06 |
| 4,030,667 | A | 6/1977 | Le Guillou et al. | |
| 4,035,303 | A | 7/1977 | Ufferfilge | |
| 4,122,978 | A | 10/1978 | Guimond et al. | |
| 4,141,472 | A | 2/1979 | Spitzer et al. | |
| 4,730,786 | A * | 3/1988 | Nelson | 239/590.3 |
| 5,273,191 | A | 12/1993 | Meshberg | |
| 5,507,417 | A * | 4/1996 | Webb | 222/189.11 |
| 5,527,577 | A | 6/1996 | Walters et al. | |
| 5,988,449 | A | 11/1999 | Fuchs et al. | |
| 6,484,953 | B2 * | 11/2002 | Freier | 239/461 |
| 6,837,401 | B2 | 1/2005 | Groys | |
| 2006/0144864 | A1 | 7/2006 | Groys | |

FOREIGN PATENT DOCUMENTS

| | | | |
|---|---|---|---|
| FR | 2 424 766 | A | 11/1979 |
| GB | 2 021 698 | A | 12/1979 |
| WO | WO 00/03933 | A | 1/2000 |

* cited by examiner

*Primary Examiner*—J. Casimer Jacyna
(74) *Attorney, Agent, or Firm*—Pearne & Gordon LLP

(57) ABSTRACT

An apparatus and method for discharging liquids such as vapocoolants in stream or mist form includes the use of a filter to remove contaminants from the liquid prior to dispensing through the nozzle opening. A streamlined flow of liquid is delivered to the nozzle to prevent after spray and the filter spaced from the nozzle to inhibit pulsation of the dispensed liquid stream. The filter and nozzle are provided as an assembly mounted in a passageway in the container actuator.

36 Claims, 6 Drawing Sheets

APPARATUS AND METHOD FOR DISPENSING LIQUIDS

BACKGROUND OF THE INVENTION AND RELATED ART

This application is a continuation-in-part of application Ser. No. 11/026,588, filed Dec. 30, 2004, which is a continuation of application Ser. No. 10/343,723, filed Jan. 31, 2003, now U.S. Pat. No. 6,837,401, which is a U.S. national application based on PCT/US01/29627, filed Sep. 21, 2001, which application claims the priority of provisional application Ser. No. 60/234,488, filed Sep. 22, 2000.

The present invention relates to apparatus and methods for delivery of a fine stream or mist of fluid, preferably, a liquid that has been filtered for removal of particulate contaminants. The invention has particular application to topical anesthetics and refrigerants, hereinafter collectively referred to as vapocoolants. However, the invention is also applicable to substantially any fluid or liquid wherein it is desired to provide a controlled dispensing by stream or mist deposition with regulated positional and/or volumetric delivery. For example, lightweight lubricating oils, wetting agents, cleaning solutions or water may be dispersed in a highly accurate manner. Further, the invention may be applied to a wide range of medical or pharmaceutical preparations, especially those that are topically applied for treatment and/or irrigation.

The apparatus comprises containers, associated valve arrangements and, optionally, filters that provide a long shelf life and maintain delivery characteristics over the shelf life in a manner suitable for pharmaceutical applications. The apparatus operates over a range of pressure commonly encountered in medical applications to provide substantially uniform delivery of liquid or vapocoolant. The apparatus may be constructed to provide either a stream or a mist delivery.

The fluid or liquid may be a self propellant or a propellant may be included in order to pressurize liquids having a vapor pressure insufficient to act as a self propellant. If a separate propellant is used, the propellant may comprise from 5% to 85% of the total liquid in the container.

Suitable propellants include any liquified petroleum gas that vaporizes or boils below room temperature and at a pressure of one atmosphere so that the resulting volume of the gaseous space is 5 to 700 times the volume of the liquid phase. Further, nitrogen or other inert gas may be used as a propellant.

Preferred vapocoolants include ethyl chloride, ethyl chloride-fluorocarbon blends, fluorocarbon fluids and blends of fluorocarbon fluids such as 15% dichlorodifluoromethane and 85% trichloromonofluoromethane. These CHC materials have been replaced in recent years with HFC's or hydrofluorocarbons. Useful CHC's include 1,1,1,3,3-pentafluoropropane and 1,1,1,2-tetrafluoroethane. Also, non-halogen containing low boiling fluids suitable for topical skin application may be used.

The vapocoolant will typically operate as a self-propellant by providing a suitable pressure for discharge in a vapor space above the liquid supply of vapocoolant. However, an inert gas such as nitrogen may be combined with the vapocoolant to achieve modified discharge characteristics. For convenience, the invention is described hereinafter with particular reference to ethyl chloride commonly referred to as a CHC or chlorofluorocarbon.

Ideally, the containers and associated valve arrangements for ethyl chloride should have a shelf life of three years and meet United States Pharmacopoeia ("USP") specifications as well as standard aerosol requirements for functionality. As discussed more fully below, certain medical applications also require unique jet stream characteristics over the life of the product. The USP specification for residue in ethyl chloride is 100 ppm.

Heretofore, valve-actuated spray bottles and so-called metal tube containers have been used for delivery of stream and mist flows of vapocoolant. Although such apparatus have provided effective delivery, they have not been entirely satisfactory. More particularly, it has not been possible to economically modify the prior art apparatus to comply with current FDA regulations and commercial production standards. Most notably, undesirable rates of product lost due to valve leakage have been experienced in connection with bottle apparatus. Although the metal tube apparatus provides substantially satisfactory performance, the cost of this delivery system including its threaded valve actuator is not economically attractive.

A current metal can spray system having a button actuated valve has not complied with contaminant or residue standards. That is, the vapocoolant within the spray can contains dissolved or dispersed contaminants believed to result from the solvent action of the vapocoolant on internal polymeric components of the spray can.

The vapocoolants may be used in topical application procedures requiring precise control of the area of skin contacted by the applied stream. For example, treatment of certain myofascial pain syndromes with vapocoolant in combination with stretching procedures may inactivate a trigger point and relieve the patient's pain. A discussion of myofascial pain and myofascial trigger points is provided in the International Rehabilitation Medicine Association monograph, *Myofascial Pain Syndrome Due to Trigger Points*, by David G. Simons M. D., November 1987, incorporated herein by reference. One specific myofascial therapy is the spray and stretch method of treatment which permits gradual passive stretch of the muscle and inactivation of the trigger point mechanism. To that end, a jet stream of vapocoolant is applied to the skin in one-directional parallel sweeps. Initially, one or two sweeps of spray precede stretch to inhibit the pain and stretch reflexes. The spray of vapocoolant is applied slowly over the entire length of the muscle in the direction of and including the referred pain zone. As described, the stream flow and size characteristics together with precise positioning of the vapocoolant along the muscle being treated is important to achieve inactivation of the trigger point mechanism.

In such procedures, a stream delivery of relatively small dimension is preferred. For example, the diameter of the stream at the valve nozzle may be in the range of several thousandths of an inch, e.g., from about 0.004" to about 0.015". Preferably, the delivery flow is stable and the stream configuration is sufficiently maintained to achieve the desired skin contact area with the valve nozzle being positioned up to about 10 or 15 inches from the patient.

In order to achieve such stream stability, the fluid delivery components of the container must not be affected excessively by changes in pressure that occur with change of container orientation during stream application and reduction of the vapocoolant supply within the container during the application life of the container, i.e. the time period within which the container is periodically used before emptied of vapocoolant. Similarly, the button valve itself must receive the flow of vapocoolant from the supply thereof within the container and establish satisfactory fluid flow characteristics prior to the exit of the fluid from the nozzle opening.

The achievement of a fine jet stream requires a nozzle having a highly uniform orifice or opening that is free of dimensional irregularities. For example, a nozzle opening having a diameter of about 0.005" preferably has a size tolerance of ±0.0005" along a length in the order of 0.02".

The reliable provision of such jet stream flows has heretofore been inhibited by the presence of contaminants which may result from in situ formed solid residues or derived from the spray apparatus including the container, valve, actuator and/or flow passage surfaces contacted by the liquid being dispensed, such as a vapocoolant.

Such contaminants may partially block or otherwise sufficiently inhibit or alter flow through the nozzle discharge bore and/or opening so as to prevent the achievement of the desired jet stream. Such contaminants may result from plastic dip tubes and actuator elements that retain manufacturing debris of extremely small size, e.g., elongated flash debris having a 0.0005" diameter and a 0.010" length.

The assembly of the valve components has been found to be another source of contaminants. The valve assembly is typically characterized by closely fitted elongated components such as a movable valve member and a spring element mounted within a valve body. Cleaning techniques including washing and vacuum removal are economically undesirable and often not sufficiently reliable.

In addition to contaminate problems, fine streams have been characterized by "after spray" comprising the phenomenon of continued spray after release of the actuator button. Such after spray is undesirable since the user may not continue to direct the spray in the proper direction believing it to be terminated by button release. Generally, after spray is not a problem with nozzle openings exceeding 0.008" as used, for example, in connection with mist sprays.

Fine stream sprays have also been found to be characterized by undesirable pulsations during spray delivery. This may result in uneven application rates and disconcerting effects upon the person using the spray apparatus.

SUMMARY OF THE INVENTION

It has now been found that effective and economical container apparatus and methods may be provided for delivery of stream and mist flows of liquids including vapocoolants of both the CHC and HFC types. This is achieved through the judicious selection of polymeric components in accordance with the specific liquid or vapocoolant and the operating characteristics of the valve apparatus within the container.

It had also been found that fine jet stream flows of liquid may be reliably provided with filtering of the liquid. The liquid is filtered within the apparatus by a filter sized to remove debris of a size typically associated with the manufacture of the dispensing apparatus components.

Further, the container apparatus may include button-type actuators designed to cooperate with the coacting valve apparatus within the container to yield stable sealing resulting in long-term shelf life, e.g., in the order of two years. Similarly, uniform delivery and flow characteristics are achieved as the contents of the container are used during the application-life of the container.

In the illustrated embodiments, the filter function is typically provided in the button actuator. That is, a nozzle and filter assembly may be mounted in the fluid passageway bore. The nozzle and filter assembly may comprise an elongated nozzle shell that receives the filter or a separate cartridge may be provided for receiving both the filter and the nozzle.

For use with liquid petroleum gases, the valve arrangement includes a sealing surface of fluoroelastomer that has been found to provide chemical and physical stability in respect to vapocoolants in combination with resiliency characteristics necessary to long-term fluid tight sealing engagement. Surprisingly, this has been achieved in connection with button type actuators which are characterized by relatively low valve actuation forces of 4 to 9 lbs. as contrasted with the threaded valve actuators of the prior art. Moreover, this has been achieved in the harsh chemical environment of an ethyl chloride system. As noted above, such was not heretofore possible without the use of an economically unattractive threaded valve arrangement for dispensing the vapocoolant.

Accordingly, the fluoroelastomer compositions may be selected to afford the necessary inertness and sealing resiliency properties to enable an economical vapocoolant delivery container having an acceptable shelf life. Useful fluoroelastomer compositions are characterized by the following properties.

1. A durometer shore A value of 50 to 100 and more preferably 70 to 90, as measured by ASTM D2240;
2. Low permeability measured as product loss from assembled can through valve assembly in the range of less than about 3.0 g/year and preferably from about 1.0 to 2.0 g/year or less;
3. Chemical inertness in respect to ethyl chloride as characterized by gas chromatography characterization of impurities equal to less than 100 ppm;
4. A dimensional stability that exhibits limited dimensional change as required by valve design and, for example, about ±5%;
5. Low solid residue in ethyl chloride as characterized by ethyl chloride USP non-volatile residue test, the non-volatile residue less than 200 ppm.

Using the foregoing guidelines, a suitable gasket for a valve arrangement in an ethyl chloride system was formed using a commercially available fluoroelastomer sold under the DuPont trademark KALREZ 6185. KALREZ is a perfluoroelastomer that is a copolymer of tetrafluoroethylene and perfluoromethyl vinyl ether with small amounts of a perfluorinated comonomer to provide chemical cross linking sites. Satisfactory results have also been obtained with the use of fluoroelastomer sold by DuPont under the trademark VITON EXTREME.

In the foregoing application, a button actuated valve was fitted to a metal container or can. It is estimated that the valve spring developed a valve closing force of less than 5 lbs. A shelf life of about two years was achieved with little or no loss of the ethyl chloride from the metal can. Similarly, minimal contamination from solid residue occurred. Solid residue was raised by about 70 ppm over the raw material.

Similar resins include KALREZ 6221 or 6230 which are also perfluoroelastomer. Additional useful resins are sold by DuPont under the trademark ZALAK.

Other polymeric components within the container should also be selected with regard to the properties of the vapocoolant. In the case of ethyl chloride, it has been found that the dip tube may be formed of a fluorocarbon resin such as polytetrafluoroethylene.

In the case of HFC compositions, the container may have a valve sealing surface formed of butyl rubber or a similar elastomeric material. The HFC materials are not as chemically restrictive and many elastomeric sealing valve materials known in the art may be used.

The container may comprise an aluminum or steel can. Presently, it is preferred to use polymeric liners for the can interiors of aluminum. In the case of aluminum, a liner of polyamide/imide resin may be used, but an unlined container is preferred. In the case of steel, a liner of epoxy/phenolic resin may be used. These resins are known in the art and they are commercially available.

In accordance with the foregoing guidelines, one skilled in the art may select useful elastomers or fluoroelastomers by trial and error to provide a valve arrangement and container for a particular liquid or vapocoolant.

For purposes of achieving a fine jet stream of suitable dimension and sufficient integrity to enable the precision application of the liquid or vapocoolant required in certain myofascial treatments, suitable nozzle discharge bore sizes and lengths have been identified. Moreover, it has been found that such nozzles are conveniently formed of metallic materials in order to better maintain dimensional tolerances and geometric configurations.

The reliability of the container apparatus to provide such fine jet stream flows has been enhanced by filtering of the liquid or vapocoolant. More particularly, the container apparatus is provided with an in situ filter located in the flow path of the liquid or vapocoolant stream. Preferably, the filter is positioned upstream of the nozzle discharge bore.

The phenomenon of after spray has been substantially reduced, if not eliminated, by providing appropriately sized passageways between the valve and nozzle that promote a substantially streamlined flow to the nozzle opening. It has also been found that spacing of the filter and the nozzle opening inhibits pulsation in the stream of liquid emitted from the nozzle opening.

DETAILED DESCRIPTION OF THE DRAWINGS

Figure 1:
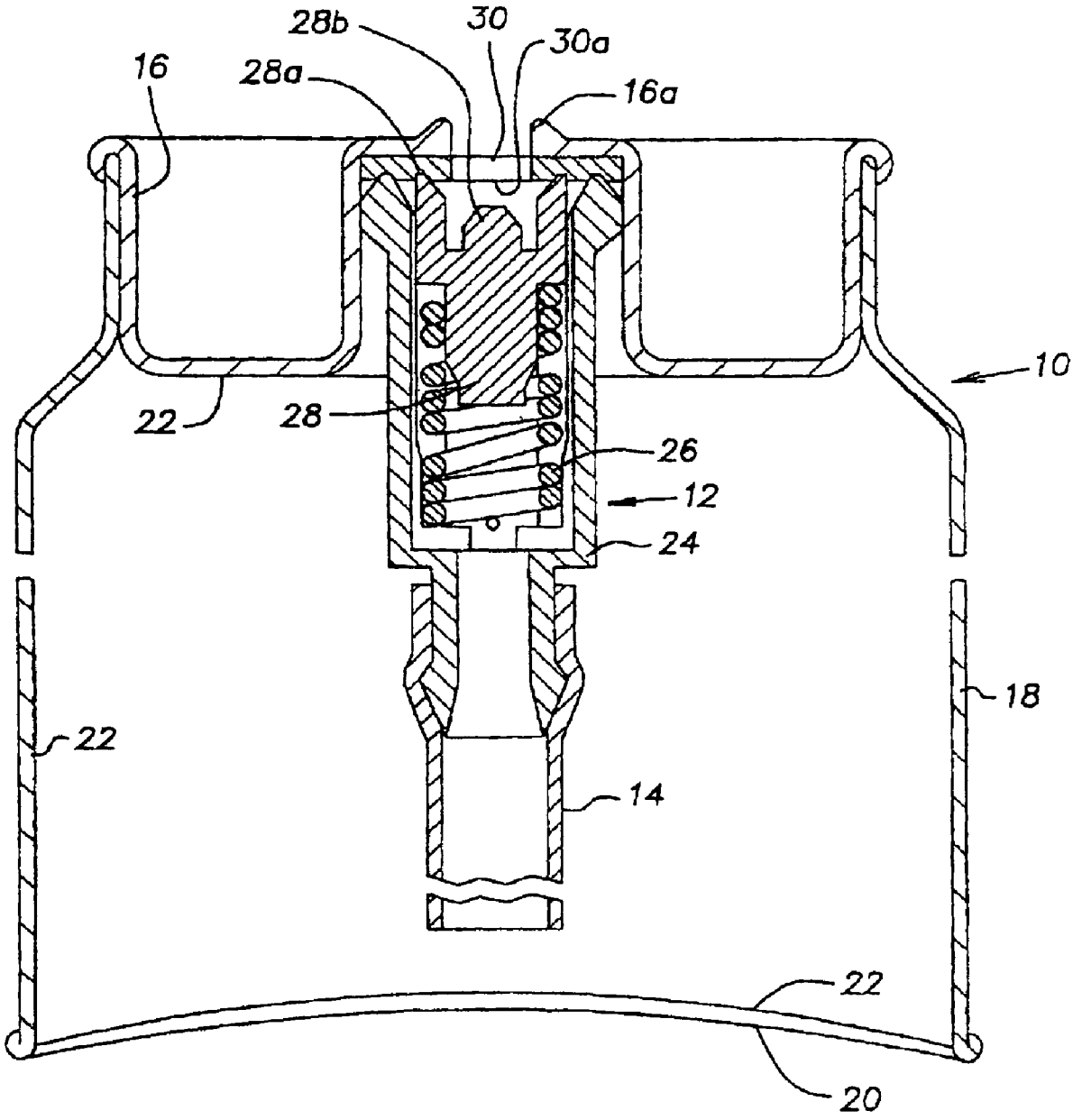
FIG. 1 is a sectional view of a container having a valve arrangement in accordance with the present invention.

Referring to FIG. 1, a container 10 includes internally mounted co-acting valve apparatus 12 having a dip tube 14. The container 10 comprises a hermetically sealed metal can including an upper mounting cup 16, a side wall 18 and a bottom wall 20. The side wall 18 is secured to the upper cup 16 and bottom wall 20 in a fluid-tight rolled joint.

The interior surfaces of the container 10 may be provided with a protective polymeric coating or film 22. As noted above, a polyamide/polyimide (PAM) resin may be used on aluminum, and an epoxy/phenolic resin may be used on steel, but an unlined container is preferred.

The container 10 is sized to hold about 3.5 ounces of vapocoolant, particularly, a CHC vapocoolant comprising ethyl chloride. However, containers may be sized to hold from about 1 ounce to about 10 ounces. The cross-sectional area of the container is selected to assure development of a vapor pressure sufficient to discharge the contents of the container.

The valve apparatus 12 includes a valve body 24 having a coil spring 26 mounted therein. Spring 26 is arranged to resiliently bias a spring cup 28 into sealing engagement with a gasket 30.

The valve body 24 and spring cup 28 may be formed of a resin material that is resistant to the ethyl chloride environment. For example, the body 24 and cup 28 may be formed of a polyamide resin such as nylon.

The spring 26 is formed of stainless steel and has a spring force sufficient to maintain a fluid tight seal between the cup 28 and gasket 30. Suitable springs have been formed of stainless steel wire having a diameter of 0.027". The spring is arranged in a coil configuration having an axial length of about 0.45" and a diameter of about 0.2". Satisfactory performance may be obtained with valve actuation forces ranging from 3 to 15 lbs. and more preferably, from about 5.5 lbs. to about 8 lbs.

The gasket 30 has an annular shape. It is formed by extrusion of the perfluoroelastomer sold under the trademark KALREZ 6185. More particularly, the elastomer is extruded in a tubular form with an outside diameter of about 0.375" and an inside diameter of about 0.139". The extrusion is transversely sliced to form the gasket 30 with a thickness of from about 0.035" to about 0.060", and more preferably, 0.042". These gasket dimensions have been found to provide suitable sealing with an annular engaging lip 28*a* provided by the spring cup 28 under the bias of the spring 26.

It should be appreciated that the upper mounting cup 16 is shown prior to clinching or crimping engagement with the valve apparatus 12. During clinching, the central hub of the cup 16 is radially compressed or clinched to firmly engage the upper annular portion of the valve body 24. The clinching process reduces the inside diameter of the gasket 30. An acceptable inside diameter range has been found to be from about 0.115" to about 0.125".

Figure 2:
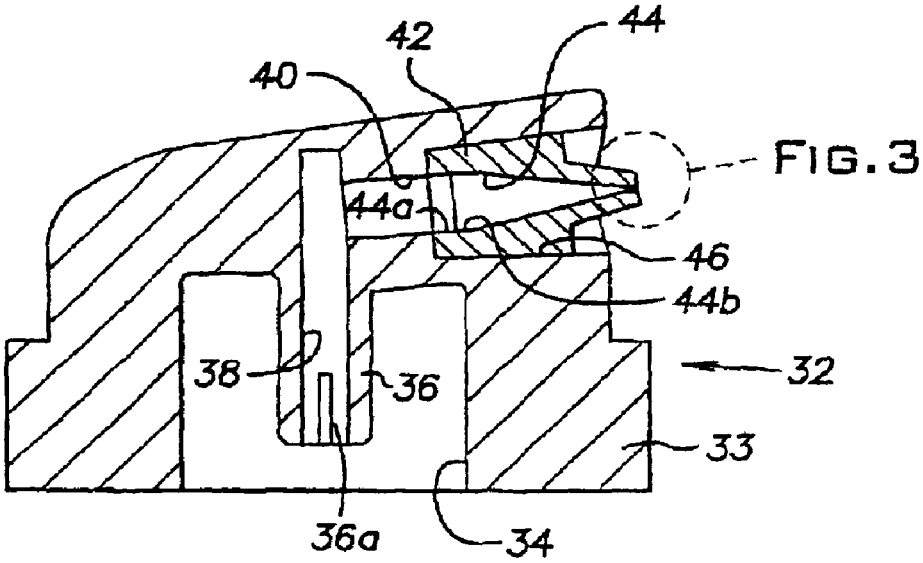
FIG. 2 is a sectional view of a button valve actuator including an insert nozzle for providing stream delivery in accordance with the present invention.

Referring to FIG. 2, a button valve actuator or cap 32 arranged to deliver a stream of vapocoolant is shown. The actuator 32 includes a body portion 33 having a mounting opening 34 sized to be mounted with a sliding friction fit to a central cap engaging lip 16*a* of the cup 16. The actuator 32 includes an annular operating leg 36 arranged to engage a central push-bulb 28*b* formed in the spring cup 28 when the actuator 32 is mounted to the lip 16*a*.

The body portion 33 of the actuator 32 is formed of a polyamide resin such as nylon. A suitable nylon resin is sold by DuPont under the trademark ZYTEL.

The actuator 32 is arranged to be mounted to the central hub, or more particularly, the lip 16*a* of the cup 16 to permit limited axial movement towards the container 10. Accordingly, the actuator 32 may be moved downward towards the container 10 to cause the operating leg 36 to move the spring cup 28 axially into the valve body 24 against the bias of the spring 26. In this manner, the engaging lip 28*a* of the spring cup is moved out of sealing engagement with lower surface 30*a* of the gasket 30.

When the valve is opened by operation of the actuator 32 to move the lip 28*a* away from the surface 30*a*, vapocoolant rises through the dip tube 14 and passes through the valve body 24 into a slot 36*a* formed in the leg 36. The vapocoolant then passes into a first bore 38 extending through the leg 36 and communicating with a second bore 40 disposed in an upper region of the actuator 32. The second bore 40 extends to a nozzle insert 42 having a tapered discharge bore 44. The nozzle insert 42 is press-fitted into a nozzle mounting bore 46.

The nozzle insert includes a cylindrical portion having a diameter of about 0.2" and an axial length of about 0.2". A tip extends about 0.1" from the spray end of the cylindrical portion. Accordingly, the total axial length of the nozzle insert is about 0.3". The nozzle insert is formed of a suitably inert resin, such as an acetyl resin sold under the trademark CELCON M70.

Figure 3:
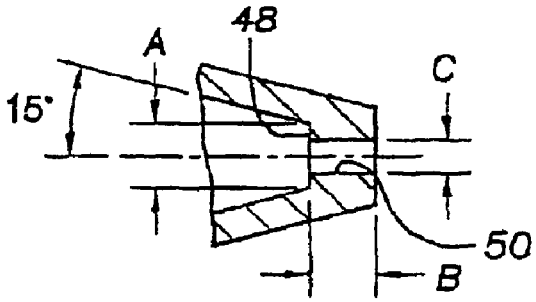
FIG. 3 is a sectional view on an enlarged scale of a portion of the nozzle tip as shown in FIG. 2.

The discharge bore 44 is provided with a smooth surface and a relatively shallow angle of inclination equal to about 150 from the center line to the adjacent interior surface so as to provide a cone angle of about 30°. The bore 44 includes a cylindrical portion 44*a* that has an inside diameter of 0.090" and a length of 0.060". The portion 44*a* extends to a cone portion 44*b* that is symmetrical about its longitudinal axis and terminates at a front surface 48 having a diameter "A" (FIG. 3) equal to 0.025" to 0.030". A nozzle orifice or opening 50 has an axial length "B" (FIG. 3) equal to 0.015" to 0.020" and a diameter "C" (FIG. 3) equal to 0.008". The insert 42 has a total axial length of 0.300".

The nozzle insert 42 has been found to be securely fixed within the bore 46 by friction without measurable distortion of the stream emitted through the nozzle opening 50. That is, a stream having a diameter of about 0.008" is emitted and the stream configuration is maintained at application distances ranging up to about 20 inches.

Figure 4:
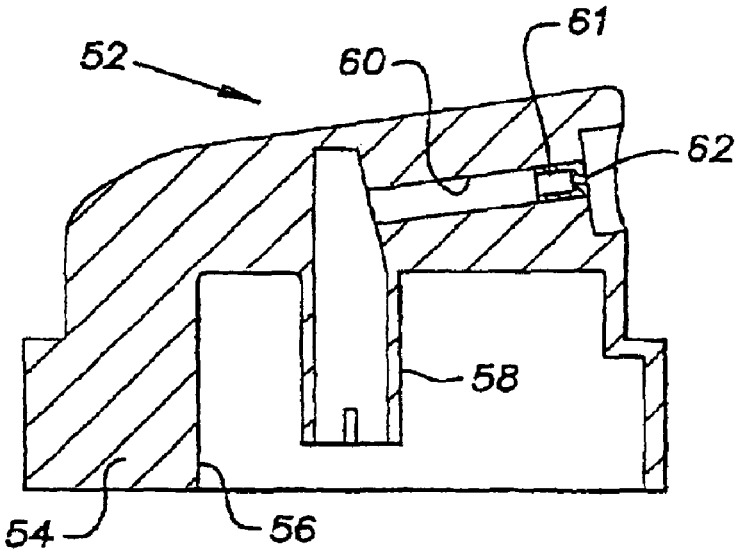
FIG. 4 is a sectional view of a button valve actuator constructed to provide a mist delivery in accordance with the present invention.

Referring to FIG. 4, a button valve actuator or cap 52 arranged to deliver a mist of vapocoolant is shown. The actuator 52 includes a body portion 54 having a mounting opening 56 and an annular operating leg 58. The actuator 52 may also be formed of the same polyamide resin as described above with respect to the actuator 32.

The mounting of the actuator 52 to the container 10 and its operation of the valve apparatus 12 is similar to that described above with respect to the actuator 32. Accordingly, this discussion is not repeated.

The delivery of a mist spray is achieved with a discharge bore 60 formed in the body portion 54 of the actuator 52. The discharge bore 60 has a substantially cylindrical configuration and receives a mist spray insert 61 that terminates at a nozzle opening 62. The circular cross section of the discharge bore 60 and nozzle opening 62 may range in diameter from 0.010" to 0.030", and more preferably, 0.015".

The mist spray emitted from the nozzle opening 62 comprises a dispersed flow of vapocoolant. The cone shape may be of about a 45° angle. A vapocoolant flow rate of about 0.3 grams/second is typical.

It should be appreciated that the dip tube 14 may be omitted to limit the container 10 to inverted-type use. Of course, internal valve apparatus may also be used to enable container operation in substantially any orientation.

Figure 5:
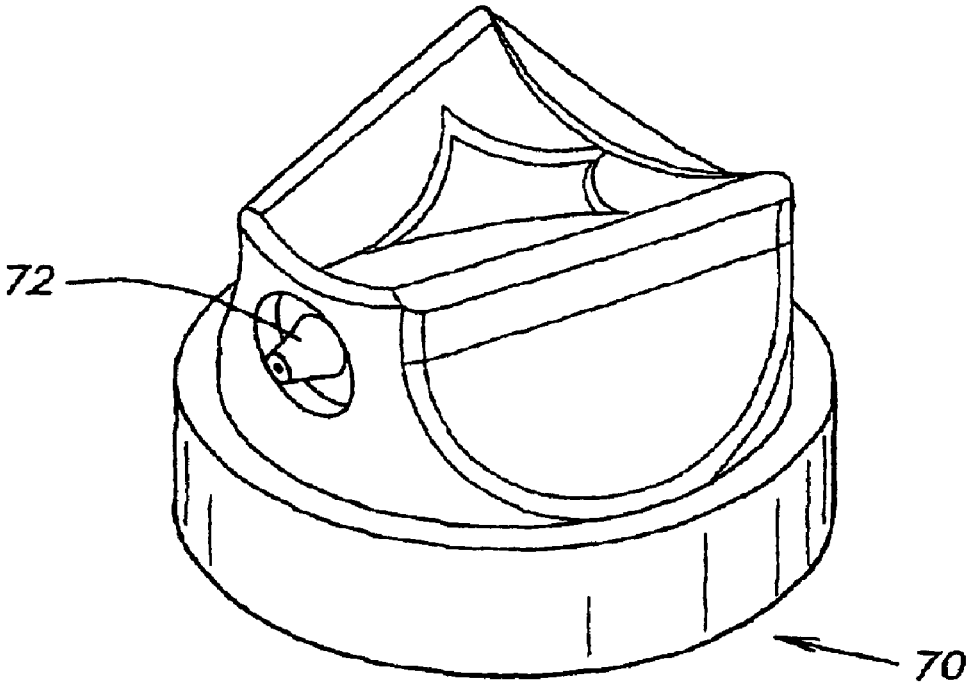
FIG. 5 is a perspective view of a button valve actuator for providing stream delivery in accordance with another embodiment of the invention.
Figure 6:
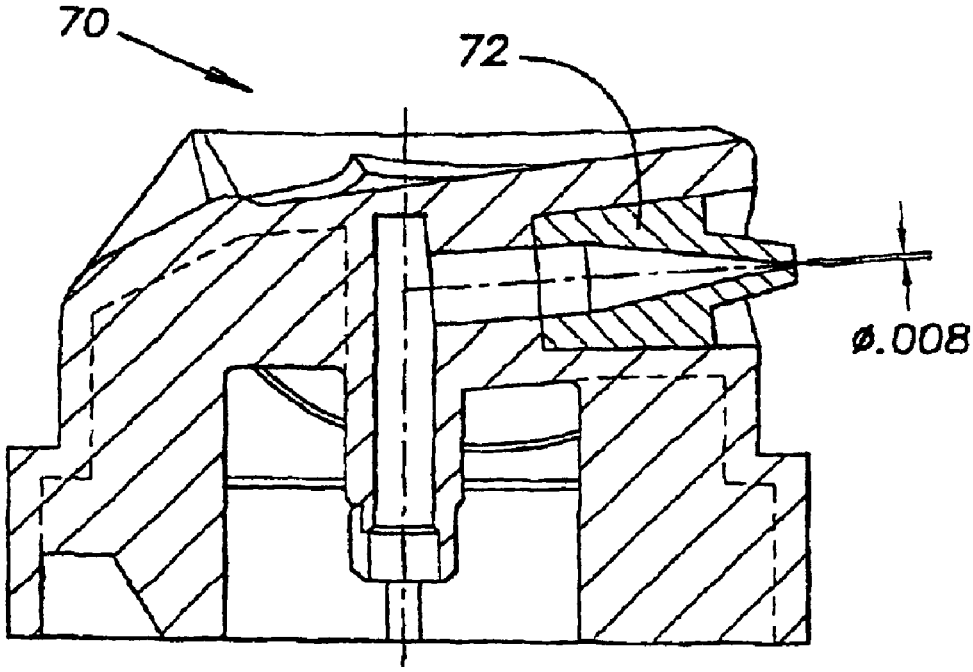
FIG. 6 is a sectional view on an enlarged scale of the button valve actuator shown in FIG. 5.

Referring to FIGS. 5 and 6, a button valve actuator or cap 70 in accordance with another embodiment is shown. The valve actuator includes an insert 72 that emits a jet stream.

Figure 7:
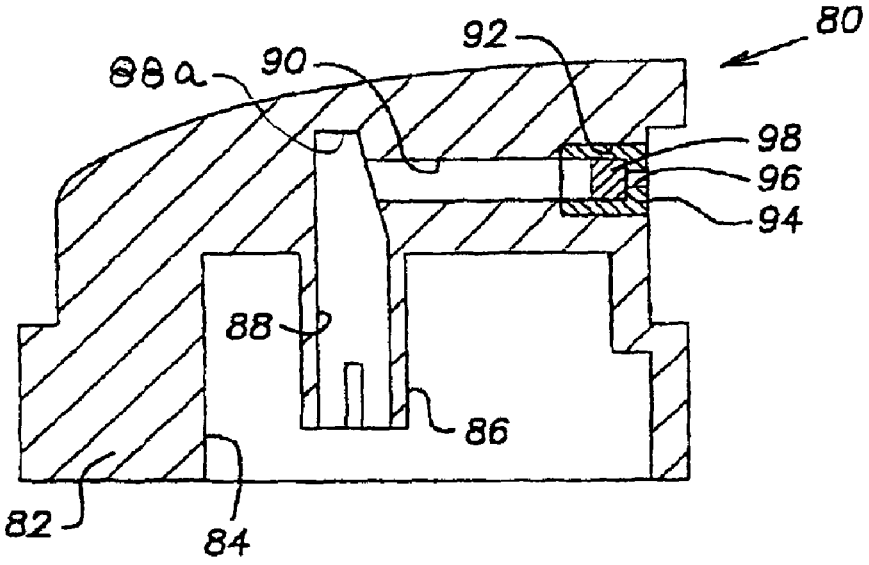
FIG. 7 is a sectional view of a button valve actuator including a nozzle and a filter for providing stream delivery in accordance with another embodiment of the invention.

Referring to FIG. 7, a button valve actuator or cap 80 arranged to deliver a jet stream of a vapocoolant is shown. The actuator 80 includes a body portion 82 having a mounting opening 84 and an annular operating leg 86. The actuator 80 may also be formed of the same polyamide resin as described above with respect to the actuator 32.

It should be appreciated that the actuator 80, as well as those discussed above, are male actuators with an extending leg adapted to be received in an opening in the container top to operate the valve. However, female actuators having a similar leg for receiving an extending conduit from the valve may be used in accordance with the invention.

The mounting of the actuator 80 to the container 10 and its operation of the valve apparatus 12 is similar to that described above with respect to the actuator 32. Accordingly, the annular leg 86 includes a first bore 88 communicating with a second bore 90 that terminates at a nozzle mounting bore 92. A nozzle 94 having a nozzle orifice or opening 96 is mounted with an interference fit in the bore 92. The valve apparatus 12 and annular leg 86 cooperate with the bores 88 and 90 to provide a passageway to convey liquid vapocoolant from the supply thereof in the container 10 to the nozzle 94 for discharge through the nozzle opening 96.

The nozzle 94 may be provided with various exterior configurations as required in a particular actuator structure. The nozzle 94 is preferably formed of a metallic material such as brass or stainless-steel. The use of such a metallic material facilitates the provision of the nozzle opening 96 with dimensions sufficiently small to provide the desired jet stream. For example, electrical discharge machining (EDM) may be used to form the opening 96 with uniform dimensions and surfaces substantially free of irregularities in the nature of burrs or other shaping defects. Of course, the opening 96 may be formed by other manufacturing techniques such as drilling or laser cutting.

The nozzle orifice or opening 96 may range in diameter size from 0.004" to 0.015" with a tolerance of about 0.0005" and a length of about 0.02". A smaller diameter size tends to overly limit the flow of vapocoolant so that the cooling therapeutic effect is not obtained upon impingement of the stream on the skin. Increasing pressures do not provide sufficient increases in flow and/or tend to cause splash back at relatively high pressures, e.g., 60 psi, which tends to inhibit the desired skin cooling effects. On the other hand, diameter sizes greater than about 0.015" tend to result in liquid vapocoolant flows that are too high and are not easily limited to the desired contact width to treat specific muscles. If the pressure is excessively decreased, e.g., to values less than about 4 psi, the required jet stream is not achieved.

In preferred applications, a fine jet stream may be achieved with a nozzle opening diameter size in the range of from about 0.005" to about 0.007". At a pressure of about 5 psi, such a jet stream will expand to a diameter of about 0.010", and no more than about 0.015", after traveling about 4" from the nozzle opening.

A slightly larger medium jet stream may be achieved with a nozzle opening diameter size in the range of from about 0.007" to about 0.009".

The operating pressure within the container for CHCs, such as ethyl chloride, is in the range of from 4 psi to 8 psi at 70° F. The HFC's tend to require a higher operating pressure in the container, for example, 1,1,1,3,3-pentafluoropropane, 1,1,1,2-tetrafluoroethane, and mixtures thereof, require operating pressures in the range of from about 4 psi to 30 psi at 70° F.

Figure 8:
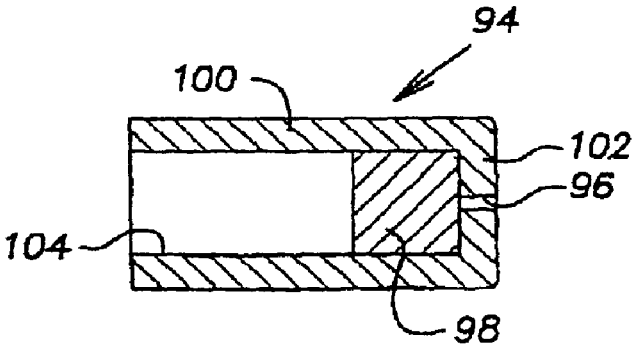
FIG. 8 is a sectional view on an enlarged scale of the nozzle and filter shown FIG. 7.

Referring to FIG. 8, a filter 98 is mounted upstream of the nozzle opening 96. More particularly, the nozzle 94 has a cylindrical shape including a sidewall 100, a front wall 102 and a rearwardly opening bore 104. The filter 98 is sized to fit tightly within the bore 104 adjacent the front wall 102 and the inlet of the nozzle opening 96. In this manner, the vapocoolant is filtered immediately prior to entering the opening 96 to substantially prevent any contaminants from entering the opening.

As previously discussed, the contaminants primarily comprise manufacturing debris associated with the dip tube, valve and actuator as well as the container. The filter may be sized to accommodate expected levels of contaminants without impeding the flow of the vapocoolant so as to prevent formation of the desired jet stream.

Figure 9:
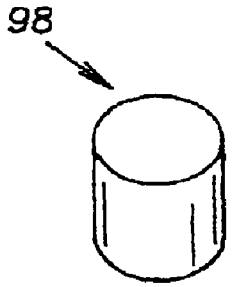
FIG. 9 is a perspective view on an enlarged scale of the filter shown in FIGS. 7 and 8.

Referring to FIGS. 8 and 9, the filter 98 has a cylindrical shape and an outside diameter sized to fit in the bore 104. The filter 98 is formed of sintered 303 stainless-steel having a pore size of 50±10 microns. As shown, the filter 98 is in the pathway of the flowing liquid vapocoolant and is designed to have a pressure drop of less than about 5 psi. Of course, the pressure drop design of the filter must take into consideration the density of the particular liquid vapocoolant. Also, as noted above, the filter is provided with a capacity sufficient to capture expected levels of contaminants without significantly affecting the flow of liquid vapocoolant and the resulting jet stream. For example, the filter 98 having a diameter of about 0.08" and a thickness of about 0.08" has been found to provide a suitable filtering capacity for 5 oz. polymeric lined metal can containers with plastic dip tube, valve and actuator constructions.

Figure 10:
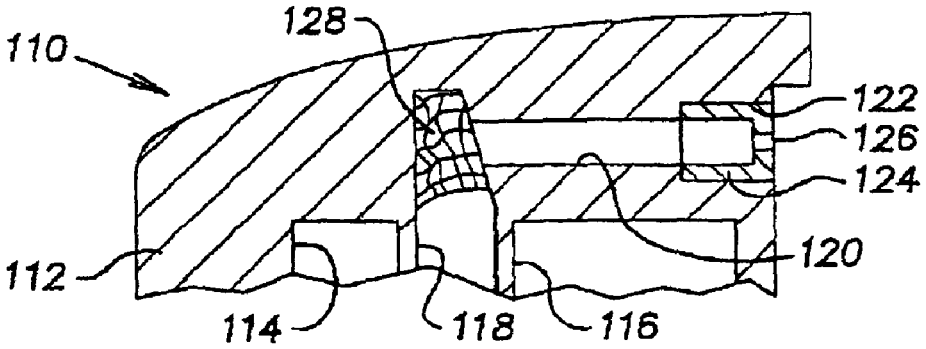
FIG. 10 is a fragmentary sectional view of a button valve actuator having a filter in accordance with another embodiment of the invention.

Referring to FIG. 10, a button valve actuator or cap 110 includes a body portion 112 having a mounting opening 114 and an annular operating leg 116. A first bore 118 and a second bore 120 cooperate to define a passageway for the liquid vapocoolant to be discharged in a jet stream. Accordingly, a nozzle mounting bore 122 has a nozzle 124 mounted therein. The nozzle 124 includes a nozzle orifice or opening 126. The nozzle 124 is similar to the nozzle 94.

In this embodiment, a filter 128 comprises a non-shedding napkin or paper material. A suitable paper filter material is KIMTEX P/N 33560 40 sold by Kimberly Clark. As illustrated, a small portion of the paper filter material weighing less than a gram is fitted into the bore 118 to block the entrance to the bore 120. In this manner, the liquid vapocoolant is filtered prior to being discharged through the nozzle 124.

Figure 11:
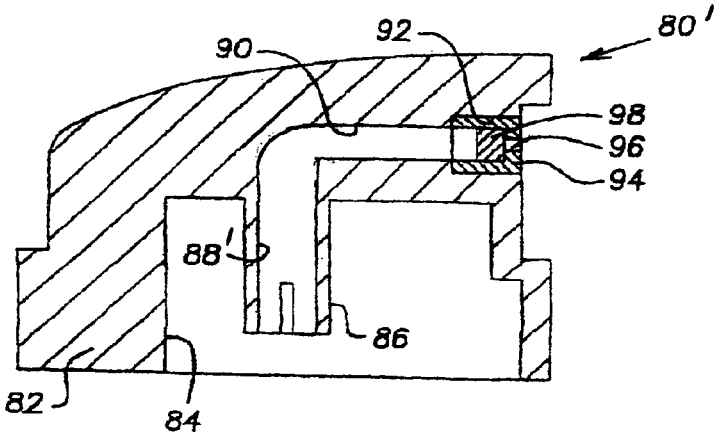
FIG. 11 is a sectional view of the button valve actuator shown in FIG. 7 further modified in accordance with the invention.

Referring to FIG. 11, a modification of the button valve actuator shown in FIG. 7 is shown. For convenience, identical parts are similarly numbered and modified elements are also similarly numbered with the addition of a prime designation. Accordingly, the actuator 80' includes a body portion 82 having a mounting opening 84 and an annular operating leg 86. The actuator 80' may be formed of the same resin as the actuator 32.

Once again, the mounting of the actuator 80' to the container 10 and the operation of the valve apparatus 12 is the same as described above. However, the first bore 88' in the annular leg 86 has a relatively smooth or continuous profile at its juncture with the bore 90 as compared with the bore 88. More particularly, referring to FIG. 7, the bore 88 includes a blind extension **88*a* that extends past the intersection with the bore 90**.

The blind extension **88*a* has been found to cause the "after spray" or continued flow of the liquid stream after release of the actuator 88. This continued flow is of relatively short duration, e.g., about one second or less, but it is undesirable since it may tend to be misdirected because the user will typically consider the dispensing and aiming completed after release of the actuator. The continued spray is believed to be associated with the additional volume provided by the blind extension 88 and excess fluid contained therein. More particularly, a pocket of gas and/or the excess fluid or liquid contained in the blind extension 88*a***, and the subsequent vaporization and/or discharge of the liquid is believed to provide the after spray.

The removal of the extension **88*a*** has also been found to eliminate, if not reduce, the occurrence of pulsation and premature stream breakup during steady-state operation. That is, the fine stream does not seem to vary in volume or velocity as observed in some instances in the past. In extreme cases, usually associated with high-pressure operation, the pulsation is sufficiently severe to be classified as stream breakup. That is, there appears to be a break in the stream prior to achieving the desired distance of uniform stream travel, e.g. 20 inches from the nozzle opening.

As noted above, the provision of a streamlined juncture between the bores 88' and 90 has been found to substantially eliminate after spray and pulsation. The mechanism of elimination is not fully understood, but it is believed to be associated with the reduction in volume and/or the provision of a streamlined flow channel for the liquid to be dispensed through the nozzle opening. These improvements are particularly valuable in connection with nozzle openings having a major dimension less than 0.008". After spray and pulsation have not been found to be as significant a problem in connection with nozzle opening sizes greater than 0.008".

Figure 12:
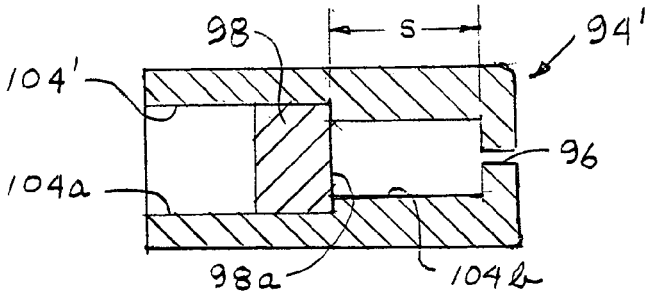
FIG. 12 is a sectional view on an enlarged scale showing a modified nozzle and filter assembly.

The reduction in pulsation and/or stream breakup has also been associated with the spacing between the filter and the nozzle opening as measured in the direction of liquid flow. Referring to FIG. 12, a nozzle 94' includes a bore 104' having an entrance portion **104*a* sized to receive the filter 98. The filter 98 is seated against the shoulder of a reduced diameter portion 104*b* of the bore 104'. The bore portion 104*b* extends between the downstream surface 98*a* of the filter 98 and the plane of the inlet of the nozzle opening 96. Accordingly, the axial length of the bore portion 104*b* corresponds with the spacing "S" between the filter 98 and the nozzle opening 96**.

For nozzle openings in the size range of 0.008", the spacing S between the filter and the nozzle opening may be as small as about 0.01". Generally, the spacing required to inhibit pulsation is related to the filter porosity and pressure drop, the operating pressure, the liquid viscosity, the fluid temperature, and the concentricity of the nozzle opening relative to the downstream passageway. Satisfactory results have been obtained for spacings in the range of from about 0.01" to about 0.20". There is no upper limit as to the spacing, and good results have been obtained for spacings of 1" or more. In view of the foregoing, trial and error using routine skill in the art may be used to determine the proper spacing.

Figure 13:
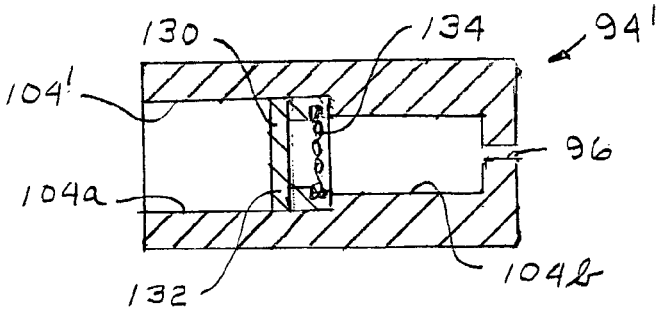
FIG. 13 is a sectional view of the nozzle of FIG. 12 having a woven metal mesh filter.

Referring to FIG. 13, the nozzle 94' is provided with a woven metal mesh filter 130. The filter 130 includes a support ring 132 having a stainless steel woven mesh 134 mounted therein.

Figure 14:
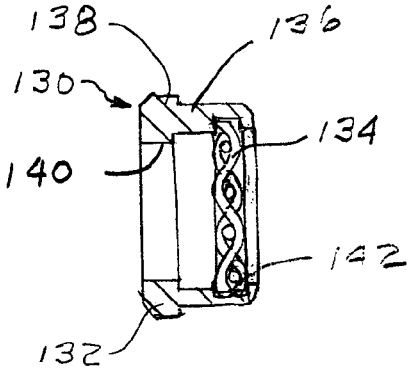
FIG. 14 is a sectional view on an enlarged scale showing the filter of FIG. 13.

Referring to FIG. 14, the support ring 132 has a generally tubular configuration including a cylindrical wall 136 sized to fit within the bore portion **104*a*. The wall 136 has a mounting shoulder 138 at its upstream end sized to mechanically interfere with the bore portion 104***a* and to further fix the filter 130 against an internal shoulder at the end of the bore.

The ring 132 includes a through passageway 140 having the mesh 134 extending transversely across it to filter liquid flowing through the passageway. The mesh 134 may be mounted to the support ring 132 in any convenient manner. In the illustrated embodiment, the cylindrical wall 136 provides an annular recess 142 adjacent the downstream end of the passageway 140. More particularly, the recess 142 is formed by an internal shoulder in the passageway 140 for receiving the mesh 134. Thereafter, the terminal end of the wall 136 is deformed radially inward to complete the recess 142 and entrap the mesh 134 within the recess.

The mesh 134 is designated as a 40 micron by 40 micron mesh, with the numerical designations referring to the dimensions of the weave openings. Accordingly, the mesh 134 will filter particles at least as small as 40 microns in size together with all larger particles. The woven mesh materials are commercially available with size designations as small as 30 micron by 30 micron mesh.

The woven metal mesh filter 130 provides a reduced pressure drop as compared with the sintered filter 98 and it is less costly. Also, it is easier to assemble in the nozzle bore 104*a*, and the support ring 132 may be provided with different peripheral shapes and surface finishes.

The mesh 134 may be replaced by a paper filter or used in combination with a paper filter formed of the above-described paper materials. The paper filter may be positioned across the passageway 140 in the same manner as the mesh 134.

Figure 15:
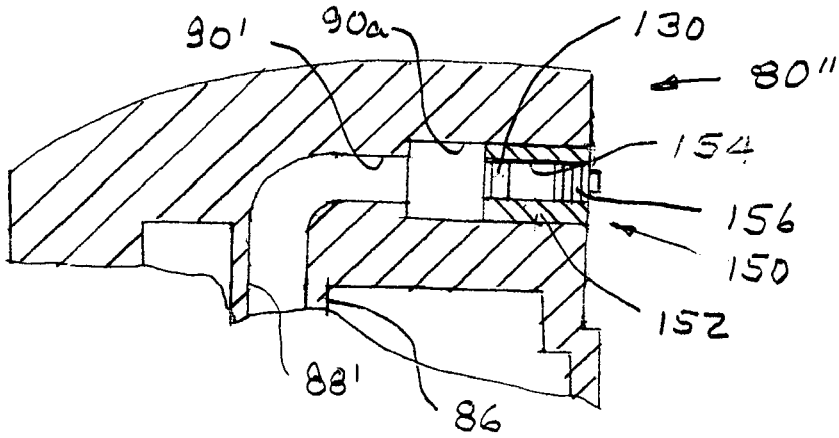
FIG. 15 is a sectional view of the button valve actuator shown in FIG. 11 further modified to include a cartridge nozzle and filter assembly in accordance with the invention.

Referring to FIG. 15, a modified button valve actuator 80" has a bore 90' including an enlarged bore portion 90*a*. The enlarged bore portion 90*a* receives a cartridge assembly 150.

Figure 16:
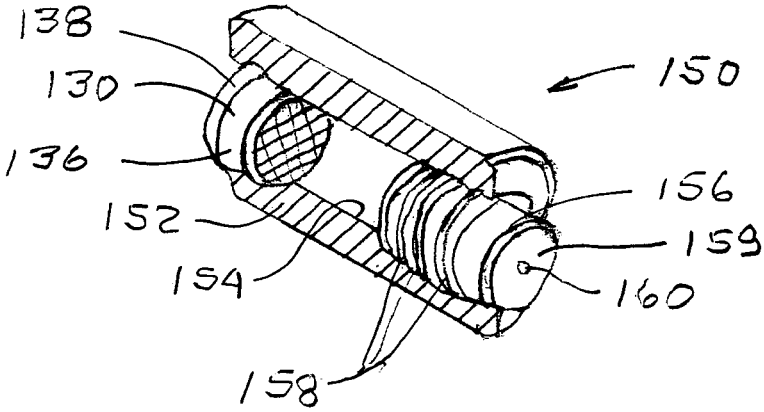
FIG. 16 is a sectional perspective view of the cartridge nozzle and filter assembly of FIG. 15.

Referring to FIGS. 15 and 16, the cartridge assembly 150 includes a mounting sleeve or shell 152 having a cylindrical shape and a central bore 154 that is substantially coaxial with the bore 90*a*. The sleeve 152 has a longitudinal length of about 0.25", and an outside diameter equal to about 0.180" so that it frictionally engages the bore 90*a* and fixes the position of the cartridge assembly 150.

The bore 154 has an inside diameter equal to about 0.1", and it is sized to receive a filter, such as the filter 130. The filter 130 is mounted adjacent the upstream end of the bore 154. The cylindrical wall 136 frictionally engages the bore 154 and the mounting shoulder 138 mechanically interferes with the surface of the bore to further fix the position of the filter.

A nozzle 156 having a generally cylindrical configuration is mounted adjacent the downstream end of the bore 154. The outer peripheral surface of the nozzle 156 includes a plurality of circular ribs 158 sized to mechanically interfere with the surface of the bore 154 and to fix the position of the nozzle. Of course, the outer surface of the nozzle 156 may be provided with any convenient profile or patterned profile to enhance engagement within the bore 154.

The nozzle 156 has a cylindrical shape with a rearwardly open flow passage, similar to the nozzle 94, that extends to a forward wall 159. A coaxial nozzle opening 160 extends through the wall 159. The nozzle opening 160 has a diameter of less than 0.004" to 0.015". The nozzle opening 160 has a diameter equal to 0.006". Accordingly, the nozzle 156 provides a fine stream spray.

It should be appreciated that the filter 130 is spaced from the nozzle 156 to inhibit pulsation and/or stream breakup during dispensing. In the illustrated embodiment, a spacing equal to about 0.06" has been found sufficient to achieve the stream flow improvements.

The sleeve 152 may be formed of polypropylene, polyethylene, polyamide or another suitable plastic depending upon compatibility with the product being sprayed. The nozzle 156 may be formed a brass, stainless steel or a plastics material.

The use of a plastic to form the sleeve 152 electrically insulates the filter 130 from the nozzle 156. This suppresses galvanic effects and otherwise tends to reduce the occurrence of corrosion.

Figure 17:
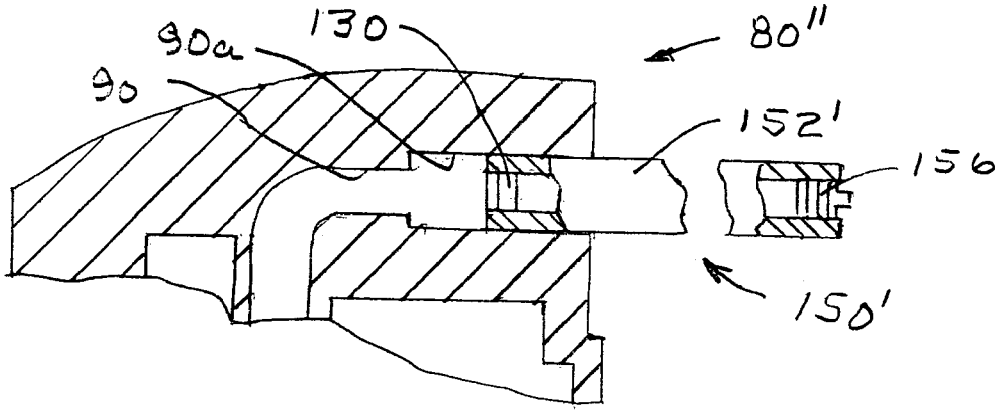
FIG. 17 is a sectional view of the button valve actuator shown in FIG. 15 further modified to include an elongated cartridge nozzle and filter assembly.

Referring to FIG. 17, the button valve actuator 80" has a modified cartridge assembly 150'. More particularly, the cartridge assembly 150' has a longitudinally extended sleeve or shell 152' that serves as a discharge tube. The length of the sleeve 152' will generally extend beyond the outer periphery of the container to which the button valve actuator is mounted and it may be as long as several inches or more. The maximum length of the sleeve 152' is limited by the sufficiency of the pressure developed to enable a sustained discharge of liquid to be emitted from the nozzle 156.

In this arrangement, the spacing between the filter 130 and the nozzle 156 is quite large, and may be in the order of several inches. As noted above, a spacing of this size does not inhibit the reduction of pulsation and/or stream breakup.

The use of sintered and woven mesh metal type filters as well as paper type filters have been described in connection with the illustrated embodiments. In addition to metal and paper type filters, polymeric membranes of suitable porosity may be used as filters. The membrane filters may be formed of polytetrafluoroethylene, polyethylene, polypropylene, cellulose and paper. A variety of suitable membranes are sold by the Whatman Group including a cellulose filter media having a separation size of 40 microns. Gelman, through Paul Life Sciences, also distributes a suitable cotton linter paper having a separation size of 30 microns.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed:

1. An apparatus for discharge of liquid in stream or mist form including a container for holding a pressurized supply of liquid, passageway means for conveying liquid from said supply thereof to a nozzle having a nozzle opening for emitting said liquid in stream or mist form, a valve having at least one movable valve element operating with a sealing surface for regulating flow of liquid through said passageway means, and a filter downstream of said valve and upstream of said nozzle opening for removing contaminants from liquid conveyed through said passageway means, said nozzle and filter comprising a cartridge assembly that is a separable element from said apparatus, said passageway means extending to an assembly mounting portion in said apparatus for frictionally receiving and mounting said assembly to said container, said assembly including a cylindrical sleeve with an outer wall forming a cylindrical assembly bore of a generally constant diameter having said nozzle and filter mounted therein, said filter comprising a support ring mounted within said assembly bore and having a woven metal mesh extending in a transverse direction across the assembly bore, said support ring including a support ring side wall forming a filter flow passage communicating with said passageway means and supporting said woven metal mesh transversely across said filter flow passage, said nozzle comprising a nozzle side wall forming a rearward open flow passage for receiving liquid flow from said filter flow passage and a forward wall providing said nozzle opening, said support ring side wall and said nozzle side wall each having an outside diameter being sized to fit in said assembly bore with sufficient friction to hold said filter and said nozzle respectively in said assembly, whereby said filter and nozzle are each self-retained in said sleeve and said sleeve is self-retained in said mounting portion of said passageway means, such that separate retention elements and/or screw threading procedures for the assembly of the filter and nozzle into the sleeve to make the cartridge assembly and for operatively locating the cartridge assembly in the mounting portion of said passageway are avoided.

2. An apparatus as in claim 1, wherein said filter is sized to restrict the flow of contaminants having a size as small as about 30 microns.

3. An apparatus as in claim 2, wherein said filter is spaced from said nozzle opening by a portion of said assembly bore that provides a substantially unobstructed and straight flow path to said nozzle opening.

4. An apparatus as in claim 3, wherein said nozzle opening has a size equal to less than b 0.008", and said filter is spaced from said nozzle opening a distance sufficient to substantially eliminate pulsations in the stream of liquid emitted from said nozzle opening.

5. An apparatus as in claim 1, wherein said passageway means comprises a passageway bore extending between said valve and said assembly having a volume sized to substantially reduce after spray following operation of said valve to a closed position.

6. An apparatus as in claim 5, wherein said passageway bore provides a substantially unobstructed and continuous flow path for said liquid that is free of blind extensions.

7. An apparatus as in claim 3, wherein said filter includes a filter exit surface from which said liquid exits the filter, said nozzle opening has an inlet in a nozzle inlet plane, and said filter exit surface is spaced in the direction of liquid flow through said assembly bore from said nozzle inlet plane.

8. An apparatus as in claim 7, wherein said filter exit surface is spaced from said nozzle inlet plane a distance of about 0.1" or more.

9. An apparatus as in claim 7, wherein said filter exit surface is spaced from said nozzle inlet plane a distance of about 1" or more.

10. An apparatus as in claim 1, wherein said support ring side wall has a tubular shape forming said filter flow passage upstream of said woven metal mesh.

11. An apparatus as in claim 1, wherein said assembly bore has a cross-sectional area for axial flow of said liquid through substantially all of said bore cross-sectional area and said filter has a circular filter cross-sectional area for axial flow of liquid through substantially all of said filter cross sectional area, said bore cross-sectional area is substantially equal to and coextensive with said filter cross-sectional area whereby pressure drop of liquid flowing through said filter is inhibited.

12. An apparatus as in claim 1, wherein said woven metal mesh is sized to restrict flow of particles having a size at least as small as said nozzle opening.

13. An apparatus as in claim 12, wherein said woven metal mesh has a mesh opening size of 40 microns by 40 microns.

14. An apparatus as in claim 1, wherein said support ring side wall and said nozzle side wall each have a length extending in the liquid flow direction, and a major portion of each of said support ring side wall length and said nozzle side wall length is frictionally engaged within said assembly bore.

15. An apparatus as in claim 1, wherein said liquid is a vapocoolant.

16. An apparatus as in claim 1, wherein said sleeve is formed of plastic and said filter and nozzle are formed of metal.

17. An apparatus as in claim 1, wherein said filter and said nozzle are spaced apart by said sleeve.

18. An apparatus as in claim 17, wherein said filter and said nozzle are spaced apart a distance greater than about 1" and said sleeve functions as a dispensing tube.

19. An apparatus as in claim 1, wherein said container includes a vapor space above said liquid that is maintained at a pressure of from about 4 psi to about 60 psi at room temperature.

20. An apparatus as in claim 1, further including a cap carried by said container and having an actuator arranged to actuate said valve, said passageway means including a passageway bore formed in said cap and extending through said cap, said passageway bore including an enlarged diameter bore portion forming said assembly mounting portion, said assembly being mounted in said enlarged diameter bore portion in said cap to remove contaminants in liquid being conveyed through said passageway bore to said nozzle opening.

21. An apparatus as in claim 20, wherein said assembly has a cylindrical shape with an axial length extending in the liquid flow direction and substantially all of said assembly axial length is received within paid enlarged diameter bore portion with said nozzle opening being exposed for emitting liquid.

22. An apparatus as in claim 21, wherein said filter and said sleeve are spaced apart a distance greater than about 1" and said sleeve functions as a dispensing tube.

23. An apparatus as in claim 1, wherein said woven metal mesh is sized to restrict flow of particles having a size at least as small as said nozzle opening.

24. An apparatus for discharge of liquid in stream or mist form including a container for holding a pressurized supply of liquid, passageway means for conveying liquid from said supply thereof to a nozzle having a nozzle opening for emitting said liquid in stream or mist form, a valve having at least one movable valve element operating with a sealing surface for regulating flow of liquid through said passageway means, and a filter for removing contaminants from liquid conveyed through said passageway means upstream of said nozzle opening, said filter being sized to restrict the flow of particles having a size as small as manufacturing debris resulting from the manufacture of plastics, said filter and said nozzle comprising a cartridge assembly that is a separable element from said apparatus, said passageway means extending to an assembly mounting passageway bore portion in said apparatus for frictionally receiving and thereby mounting said cartridge assembly to said apparatus, said cartridge assembly including a cylindrical sleeve with an outer wall forming a cylindrical assembly bore of a generally constant diameter and having said filter and nozzle mounted in the assembly bore at spaced locations in the direction the liquid is conveyed, said filter comprising a support ring mounted within said assembly bore and having a woven metal mesh extending in a transverse direction across the assembly bore, said support ring including a support ring side wall forming a filter flow passage communicating with said passageway means and supporting said woven metal mesh transversely across said filter flow passage, said nozzle comprising a nozzle side wall forming a rearward open flow passage for receiving liquid flow from said filter flow passage and a forward wall providing said nozzle opening, said support ring side wall and said nozzle side wall each being sized to frictionally engage said assembly bore and to thereby mount said filter and said nozzle in said assembly, and said assembly having a cylindrical shape with an axial length extending in the liquid flow direction and substantially all of said assembly axial length being received within said assembly mounting passageway bore portion with said nozzle opening being exposed for emitting liquid whereby said filter and nozzle are each self-retained in said sleeve and said sleeve is self-retained in said mounting passageway bore portion, such that separate retention elements and/or screw threading procedures for the assembly of the filter and nozzle into the sleeve to make the cartridge assembly and for operatively locating the cartridge assembly in the mounting passageway bore portion are avoided.

25. An apparatus as in claim 24, wherein said filter is sized to restrict the flow of contaminants having a particle size as small as said nozzle opening.

26. An actuator assembly for discharge of liquid from a container holding a pressurized supply of liquid and having a button arranged to operate a valve to regulate the supply of liquid to said actuator assembly, a filter and a nozzle, said nozzle having a nozzle opening for emitting said liquid in stream or mist form, passageway means for conveying liquid supplied to said actuator assembly to said nozzle opening, said filter being located in said passageway means upstream from said nozzle opening for removing contaminants from liquid conveyed through said passageway means, said filter and said nozzle comprising a cartridge assembly that is a separable element from said actuator assembly, said passageway means extending to an enlarged bore portion in said actuator assembly for frictionally receiving and thereby mounting said cartridge assembly to said actuator assembly, said cartridge assembly including a cylindrical sleeve forming a cartridge bore of a generally constant diameter and having said filter and nozzle mounted in the cartridge bore at spaced locations in the direction the liquid is conveyed, said filter comprising a support ring mounted within said cartridge bore upstream of said nozzle opening and having a woven metal mesh extending in a transverse direction across the cartridge bore, said support ring including a support ring side wall forming a filter flow passage communicating with said passageway means and supporting said woven metal mesh transversely across said filter flow passage, said nozzle comprising a nozzle side wall forming a rearward open flow passage for receiving liquid flow from said filter flow passage and a forward wall providing said nozzle opening, said support ring side wall and said nozzle side wall each being sized to frictionally engage said cartridge bore and to thereby mount said filter and said nozzle in said cartridge assembly, whereby said filter and nozzle are each self-retained in said sleeve and said sleeve is self-retained in said enlarged bore portion, such that separate retention elements and/or screw threading procedures for the assembly of the filter and nozzle into the sleeve to make the cartridge assembly and for operatively locating the cartridge assembly in the enlarged bore portion are avoided.

27. An actuator assembly as in claim 26, wherein said filter is sized to restrict the flow of contaminants having a size as small as about 30 microns.

28. An actuator assembly as in claim 26, wherein said nozzle opening has a diameter in the range of from about 0.004" to about 0.015", and said filter is sized to restrict the flow of contaminants having a size at least as small as said nozzle diameter opening.

29. An actuator assembly as in claim 28, wherein said support ring side wall has a tubular shape forming said filter flow passage.

30. An actuator as in claim 29, wherein said cartridge bore has an area generally equal to the area of said filter flow passage and a substantially uniform diameter between said filter and said nozzle.

31. An actuator assembly as in claim 29, wherein said sleeve has an axial length extending in the liquid flow direction, substantially all of said sleeve axial length being within said enlarged bore portion with said nozzle opening being exposed for emitting liquid.

32. An actuator assembly for discharge of liquid from a container holding a pressurized supply of liquid and having a button arranged to operate a valve to regulate the supply of liquid to said actuator assembly, said actuator assembly including a filter and a nozzle located downstream of said valve, said nozzle having a nozzle opening for emitting said liquid in stream or mist form, passageway means for conveying liquid supplied to said actuator assembly to said nozzle opening, a cylindrical cartridge that is a separable element from said actuator assembly, said passageway means extending to an enlarged bore portion in said actuator assembly for frictionally receiving and thereby mounting said cartridge to said actuator assembly, said cartridge having a cylindrical sleeve forming a cartridge bore of generally constant diameter for conveying liquid, said filter and said nozzle being mounted in said cartridge bore with said filter being located upstream from said nozzle opening for removing contaminants from liquid conveyed through said passageway means, said support ring including a cylindrical support wall forming a filter flow passage communicating with said passageway means and supporting said woven metal mesh transversely across said filter flow passage, said nozzle comprising a cylindrical nozzle wall forming a rearward open flow passage and a forward wall providing said nozzle opening, said cylindrical support wall and said cylindrical nozzle wall each being sized to frictionally engage said cartridge bore and to thereby mount said filter and said nozzle in said cartridge, whereby said filter and nozzle are each self-retained in said sleeve and said sleeve is self-retained in said enlarged bore portion, such that separate retention elements and/or screw threading procedures for the assembly of the filter and nozzle into the sleeve to make the cartridge assembly and for operatively locating the cartridge assembly in the enlarged bore portion are avoided.

33. An actuator as in claim 32, wherein, said filter is spaced from said nozzle opening, said cartridge is contained substantially entirely in said enlarged bore portion with said nozzle opening exposed for emitting liquid.

34. An actuator as in claim 33, wherein said bore portion is spaced from said nozzle opening a distance of about 0.1" or more.

35. An actuator as in claim 34, wherein said woven metal mesh has a mesh opening sized to restrict flow of particles having a size at least as small as said nozzle opening.

36. An actuator as in claim 35, wherein said sleeve is formed of plastic and said filter and nozzle are formed of metal.

* * * * *